US006289603B1

(12) United States Patent
Lescanne et al.

(10) Patent No.: US 6,289,603 B1
(45) Date of Patent: Sep. 18, 2001

(54) COMBINED BLOWING AND SUCTION SYSTEM WITH INTEGRAL ENERGY EXCHANGE FOR A DRYING INSTALLATION

(75) Inventors: Yannick Lescanne, Lille; Jean-Pierre Robin, Bondues, both of (FR)

(73) Assignee: Solaronics Process SA (FR)

( * ) Notice: Subject to any disclaimer, the term of this patent is extended or adjusted under 35 U.S.C. 154(b) by 0 days.

(21) Appl. No.: 09/506,222

(22) Filed: Feb. 17, 2000

(30) Foreign Application Priority Data

Feb. 18, 1999 (FR) ..... 99 02020

(51) Int. Cl.[7] ..... F26B 7/00

(52) U.S. Cl. ..... 34/60; 34/274; 34/418; 34/426

(58) Field of Search ..... 34/273, 274, 535, 34/548, 579, 581, 90, 418, 419, 426, 427, 632, 635, 643, 60, 267

(56) References Cited

U.S. PATENT DOCUMENTS

| | | | | |
|---|---|---|---|---|
| 3,460,265 | * | 8/1969 | Smith, Jr. | 34/267 |
| 5,619,808 | * | 4/1997 | Pabst | 34/640 |
| 5,937,540 | * | 8/1999 | Lee | 34/267 |
| 6,088,930 | * | 7/2000 | Robin et al. | 34/267 |

* cited by examiner

*Primary Examiner*—Gregory Wilson
(74) *Attorney, Agent, or Firm*—Bachman & LaPointe, P.C.

(57) ABSTRACT

A dryer for drying continuous strips of paper uses blowing and suction airflows. The temperature of the suction airflow is higher than the temperature of the blowing airflow. The dryer exchanges energy between the blowing and suction airflows.

8 Claims, 2 Drawing Sheets

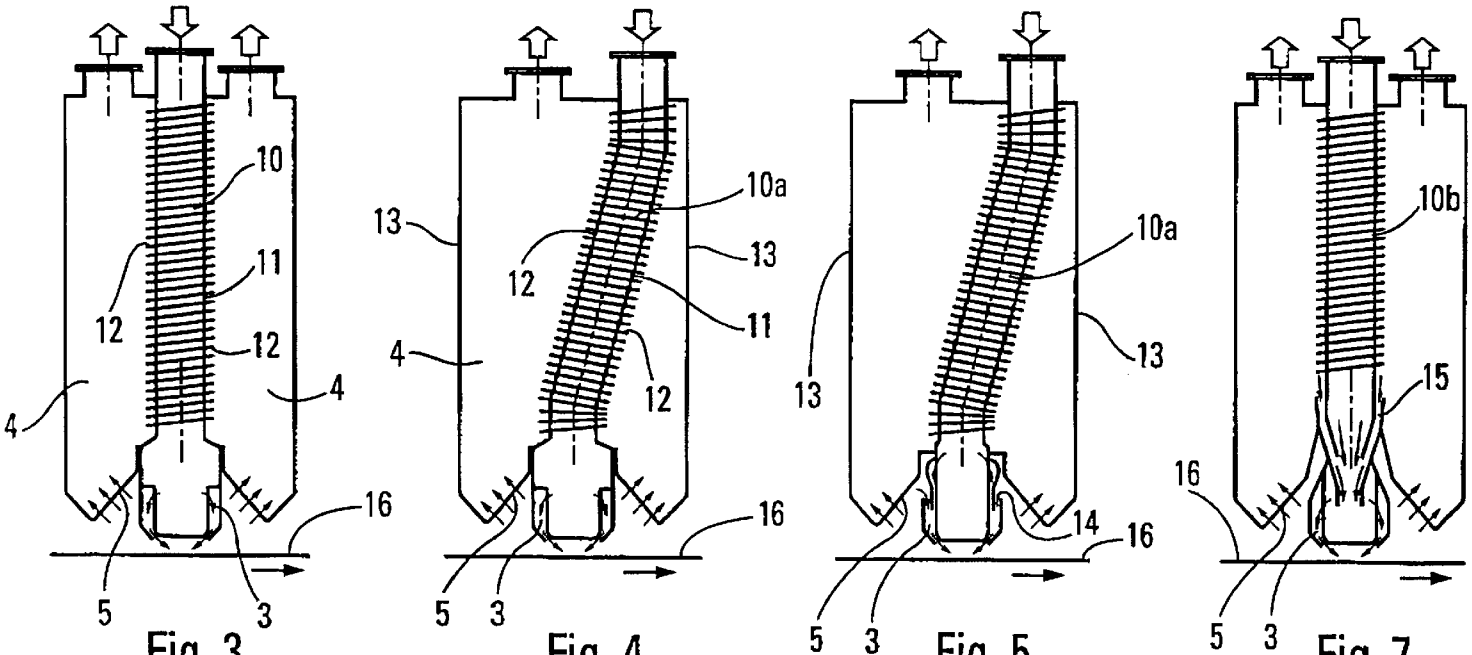
Fig. 3
Fig. 4
Fig. 5
Fig. 7
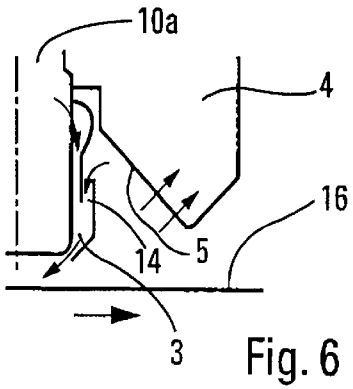
Fig. 6

COMBINED BLOWING AND SUCTION SYSTEM WITH INTEGRAL ENERGY EXCHANGE FOR A DRYING INSTALLATION

BACKGROUND OF THE INVENTION

1. Field of the Invention

The present invention relates to a combined blowing and suction system integrating exchange of energy between the two airflows.

2. Description of the Prior Art

Many operations performed on continuously moving strips, for example strips of paper, necessitate an input of energy. Drying is one such operation.

To preserve the quality of the surface state of the strip it is often indispensable for this input of energy to be without contact.

The techniques routinely used to dry a continuously moving strip without contact are:

convection drying using hot air;

infrared drying using radiant burners.

Both these techniques must combine input of energy and of mass to perform the drying operation efficiently. In both cases blowing and suction means are employed.

Hot air dryers blow hot air onto the surface of the moving strip to transfer energy and mass at the same time. The blowing air charged with moisture is then evacuated via suction means.

Infrared dryers deliver energy in the form of radiation. Mass is transferred by blowing air parallel to the surface of the moving strip. The blowing air charged with moisture is then evacuated via suction means.

Both these technologies have to input maximum energy in the smallest possible space. These two imperatives are mutually incompatible because:

the efficiency of energy input by convection increases as the temperature of the blowing air increases, but the overall size of the drying installation increases as the temperature of the blowing air increases.

The object of the present invention is to propose a combined blowing and suction system which operates at a high blowing temperature but reduces the volume of the airflows.

In conventional hot air dryers the temperature of the sucked air charged with moisture is lower than the temperature of the blowing air. It is therefore necessary to prevent energy exchange between the two airflows because the energy input would otherwise be reduced.

In infrared dryers the temperature of the sucked moist air is higher than the temperature of the blowing air because the energy losses from the radiating elements heat the mixture of blowing air and water vapor produced by evaporation. It would therefore appear to be beneficial to transfer energy between the two airflows in order to reduce the temperature of the sucked air to the benefit of the temperature of the blowing air. However, the traditional arrangement of the blowing and suction means makes such exchanges difficult to implement.

The invention is based in particular on the combined convection/radiation system described in European patent application No. 98 402 768.0, which uses blowing and suction airflows and in which the temperature of the sucked airflow is higher than the temperature of the blowing airflow. The novel contiguous disposition of the blowing and suction means enables beneficial transfer of energy between the blowing and sucked airflows.

SUMMARY OF THE INVENTION

The invention provides a dryer which uses a blowing airflow and a suction airflow at a temperature higher than the temperature of the blowing airflow and includes means for exchanging energy between the blowing and suction airflows, a blowing chamber having a blowing air inlet and a blowing air outlet, two suction chambers adjacent and on respective opposite sides of the blowing chamber and which are separated from the blowing chamber by walls incorporating means for encouraging the exchange of heat between air flowing through the blowing chamber and air flowing through the suction chamber and each of which has a suction air inlet adjacent the blowing air outlet of the blowing chamber.

The dryer of the invention includes means for exchanging energy between the blowing and suction air flows by exchanging either heat or mass.

Thus energy is extracted from the suction air to heat the blowing air before it impinges on the surface of a continuous strip. This exchange of energy between the two airflows:

reduces the temperature and/or the volume of blowing air at the inlet of the dryer because this air is heated before it impinges on the strip, and reduces the temperature and/or the volume of the air sucked out of the dryer because this air has exchanged energy with the blowing air.

The reduced temperatures and/or volumes reduce the overall size of the dryer.

Other features and advantages of the invention will become more apparent in the course of the following description.

BRIEF DESCRIPTION OF THE DRAWINGS

In the accompanying drawings, which are given by way of non-limiting example:

FIG. 3 is a view in cross section of a first variant of the dryer.

FIG. 4 is a view in cross section of a second variant of the dryer.

FIG. 5 is a view in cross section of a third variant of the dryer.

FIG. 6 is a view to a larger scale showing a detail of the lower part of the dryer shown in FIG. 5.

FIG. 7 is a view in cross section of a fourth variant of the dryer.

DETAILED DESCRIPTION OF THE PREFERRED EMBODIMENTS

The hot air dryers shown in the accompanying drawings are part of an installation for drying a strip of paper described in European patent application No. 98 402 768.0, for example.

That installation includes a succession of hot air dryers and gas-fired radiant burners.

Each dryer uses blowing and suction airflows. Due in particular to the presence of the radiant burners between the air dryers, the temperature of the suction airflow is higher than the temperature of the blowing airflow.

According to the invention, each dryer includes means for exchanging energy between the blowing and suction airflows.

In the dryers shown in FIGS. 1 to 4, the above means exchange heat between the blowing and suction airflows.

In the dryers shown in FIGS. 5 to 7 the above means mix the blowing and suction airflows.

Figure 1:
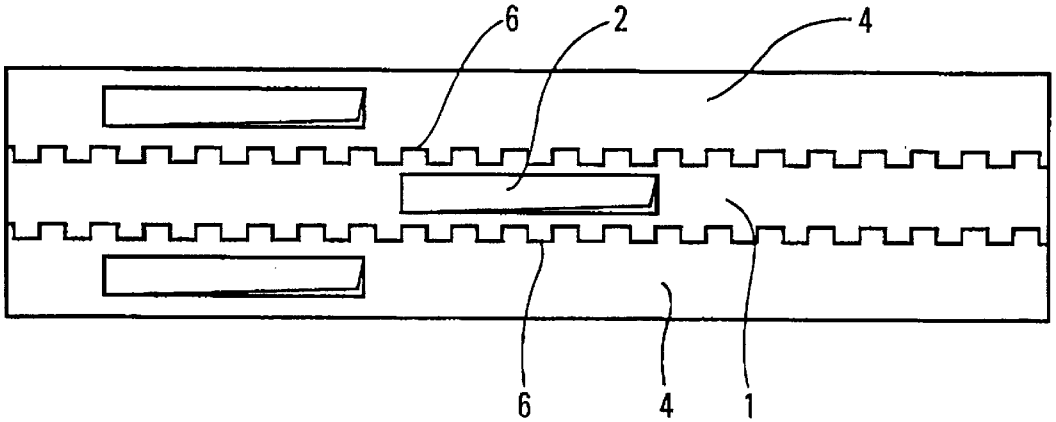
FIG. 1 is a view in longitudinal section of a dryer according to the invention.
Figure 2:
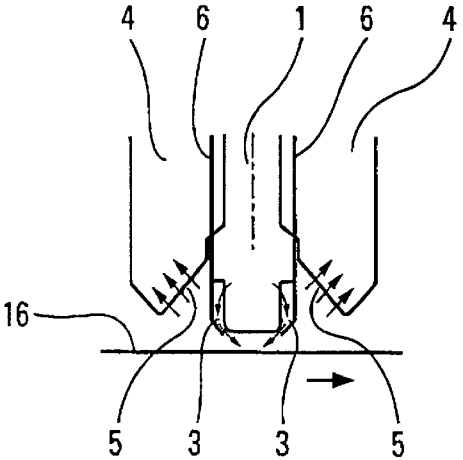
FIG. 2 is a partial view in cross section of the dryer shown in FIG. 1 and shows a strip of paper moving continuously under the dryer.

The embodiment of the dryer shown in FIGS. 1 and 2 includes a blowing chamber 1 which has a blowing air inlet 2 and a blowing air outlet 3. The blowing chamber 1 is adjacent two suction chambers 4 each of which has a suction air inlet 5 adjacent the blowing air outlet 3 of the blowing chamber 1 (see FIG. 2).

The blowing chamber 1 is separated from each suction chamber 4 by a wall 6 having a crenellated or corrugated profile to encourage the exchange of heat between air flowing through the blowing chamber 1 and air flowing through the suction chambers 4.

The blowing chamber of the dryers shown in FIGS. 3 to 6 is made up of a series of tubes 10, 10*a*, 10*b* whose wall 11 carries fins 12 projecting into the interior of the suction chambers 4 to encourage the exchange of heat.

As in FIGS. 1 and 2, the two suction chambers 4 are disposed symmetrically on respective opposite sides of the blowing chamber.

The blowing tubes 10*a* of the variants shown in FIGS. 4 and 5 lie in a plane inclined to the vertical lateral walls 13 of the two suction chambers 4.

This arrangement increases the surface area of the tubes 10*a*, which encourages the exchange of heat.

The blowing tubes 10*a*, 10*b* of the examples shown in FIGS. 5 to 7 include a duct 14, 15 on the upstream side of their blowing air outlet 3 shaped to suck air by the Venturi effect in order to mix that air with the blowing air at the outlet from the blowing tubes 10*a*, 10*b*.

In the example shown in FIGS. 5 and 6, air is sucked into the ducts 14 near the suction inlet of the suction chambers 4. Consequently, some of the air sucked into the suction chambers is mixed with blowing air from tubes 10*a*.

In the example shown in FIG. 7 the suction airflow in the chambers 4 is sucked into the duct 14 whose inlet is inside those chambers.

The suction and blowing airflows could instead be mixed by mechanical means.

In all the examples just described, the temperature of the suction airflow is higher than the temperature of the blowing airflow. The exchange of energy between the suction and blowing airflows heats the air blown onto the paper strip 16, which makes drying more efficient.

Of course, the invention is not limited to the examples just described, to which many modifications can be made without departing from the scope of the invention.

What is claimed is:

1. A dryer which uses a blowing airflow and a suction airflow at a temperature higher than the temperature of said blowing airflow and includes means for exchanging energy between said blowing and suction airflows, a blowing chamber having a blowing air inlet and a blowing air outlet, two suction chambers adjacent and on respective opposite sides of said blowing chamber and which are separated from said blowing chamber by walls incorporating means for encouraging the exchange of heat between air flowing through said blowing chamber and air flowing through said suction chamber and each of which has a suction air inlet adjacent said blowing air outlet of said blowing chamber.

2. The dryer claimed in claim 1 wherein said two suction chambers are symmetrically disposed on respective opposite sides of said blowing chamber.

3. The dryer claimed in claim 1 wherein said means for exchanging energy between said blowing and suction airflows are adapted to mix said blowing and suction airflows.

4. The dryer claimed in claim 3 wherein said two airflows are mixed by mechanical means.

5. The dryer claimed in claim 1 wherein said walls have a crenellated or corrugated profile.

6. The dryer claimed in claim 1 wherein said walls carry fins projecting into said two suction chambers.

7. The dryer claimed in claim 6 wherein said blowing chamber lies in a plane inclined to vertical lateral walls of said two suction chambers.

8. The dryer claimed in claim 1 wherein said blowing chamber has on the upstream side of its blowing air outlet a duct shaped to suck air from said suction airflow by a Venturi effect in order to mix that air with said blowing airflow at the outlet of said blowing chamber.

* * * * *